US011425800B2

(12) United States Patent
Mathis

(10) Patent No.: US 11,425,800 B2
(45) Date of Patent: Aug. 23, 2022

(54) MICROWAVE ROTARY KILN

(75) Inventor: Milt D. Mathis, Roseville, MN (US)

(73) Assignee: Milt Mathis, Roseville, MN (US)

( * ) Notice: Subject to any disclaimer, the term of this patent is extended or adjusted under 35 U.S.C. 154(b) by 812 days.

(21) Appl. No.: 13/877,892

(22) PCT Filed: Oct. 7, 2011

(86) PCT No.: PCT/US2011/055462

§ 371 (c)(1),
(2), (4) Date: Apr. 4, 2013

(87) PCT Pub. No.: WO2012/048284

PCT Pub. Date: Apr. 12, 2012

(65) Prior Publication Data

US 2013/0200071 A1 Aug. 8, 2013

Related U.S. Application Data

(60) Provisional application No. 61/390,828, filed on Oct. 7, 2010.

(51) Int. Cl.

| | |
|---|---|
| ***H05B 6/80*** | (2006.01) |
| ***H05B 6/64*** | (2006.01) |
| ***F27B 7/20*** | (2006.01) |
| ***F27D 11/12*** | (2006.01) |
| ***F27B 7/34*** | (2006.01) |
| *F27D 99/00* | (2010.01) |

(52) U.S. Cl.

CPC ..... *H05B 6/6402* (2013.01); *F27B 7/20* (2013.01); *F27B 7/34* (2013.01); *F27D 11/12* (2013.01); *F27D 2099/0028* (2013.01)

(58) Field of Classification Search

CPC ..... H05B 6/80; H05B 6/00
USPC ..... 219/701, 738, 756, 763
See application file for complete search history.

(56) References Cited

U.S. PATENT DOCUMENTS 3,749,874 A * 7/1973 Edgar ..... H05B 6/76 219/699
3,952,421 A * 4/1976 Wilson ..... D21F 5/00 219/774

(Continued)

FOREIGN PATENT DOCUMENTS

CN 1898017 A 1/2007
CN 201129918 Y 10/2008

(Continued)

OTHER PUBLICATIONS

Response to Examiner's Report dated Mar. 24, 2015, from counterpart Australian Patent Application No. 2011311838, filed Jun. 19, 2015, 8 pp.

(Continued)

*Primary Examiner* — Jimmy Chou
*Assistant Examiner* — Lawrence H Samuels
(74) *Attorney, Agent, or Firm* — Shumaker & Sieffert, P.A.

(57) ABSTRACT

An apparatus includes a microwave source emitting energy in a frequency range of about 300 Mhz to about 300 Ghz. At microwave cavity includes a stationary input section, a stationary output section, and a rotating processing section between the input section and the sample output section. A waveguide introduces microwave energy into at least one of the sample input section and the sample output section.

24 Claims, 7 Drawing Sheets

(56) References Cited

U.S. PATENT DOCUMENTS

| | | | | | |
|---|---|---|---|---|---|
| 4,037,070 | A * | 7/1977 | Kirpichnikov | H05B 6/6411 | 219/701 |
| 4,310,739 | A * | 1/1982 | Hatem | H05B 6/802 | 219/400 |
| 4,406,937 | A * | 9/1983 | Soulier | F26B 3/347 | 219/686 |
| 4,441,003 | A * | 4/1984 | Eves, II | A21B 1/48 | 198/570 |
| 4,559,429 | A * | 12/1985 | Holcombe | H05B 6/04 | 219/759 |
| 4,677,278 | A * | 6/1987 | Knoll | G07F 9/105 | 219/214 |
| 5,227,026 | A | 7/1993 | Hogan | | |
| 5,718,356 | A * | 2/1998 | Nottingham | B05C 17/00546 | 219/687 |
| 5,961,870 | A * | 10/1999 | Hogan | B01J 8/10 | 219/679 |
| 6,020,579 | A * | 2/2000 | Lewis | B01J 19/126 | 219/690 |
| 6,104,015 | A | 8/2000 | Jayan et al. | | |
| 6,833,537 | B2 * | 12/2004 | Risman | H05B 6/70 | 219/690 |
| 2004/0104514 | A1 * | 6/2004 | Ishikawa | B28B 3/206 | 264/489 |
| 2004/0182855 | A1 * | 9/2004 | Centanni | A61L 2/07 | 219/628 |
| 2006/0054618 | A1 | 3/2006 | Agrawal et al. | | |
| 2008/0099325 | A1 | 5/2008 | Ludlow-Palafox et al. | | |
| 2008/0302787 | A1 * | 12/2008 | Erskine | F26B 3/30 | 219/679 |
| 2010/0025394 | A1 * | 2/2010 | Jussel | A61C 13/203 | 219/756 |
| 2010/0025395 | A1 * | 2/2010 | Laubersheimer | H05B 6/80 | 219/759 |
| 2010/0032429 | A1 * | 2/2010 | Rundquist | F27B 14/14 | 219/690 |
| 2010/0059509 | A1 | 3/2010 | Imai et al. | | |
| 2012/0129358 | A1 * | 5/2012 | Ogawa | H01L 21/67109 | 438/795 |

FOREIGN PATENT DOCUMENTS

| | | | |
|---|---|---|---|
| EP | 2530059 | A1 | 12/2012 |
| JP | 2005331158 | A | 12/2005 |
| JP | 2008264656 | A | 11/2008 |
| JP | 2009-97773 | | 5/2009 |
| KR | 20010075210 | A | 9/2001 |
| KR | 20090008960 | U | 9/2009 |
| WO | 9902016 | A1 | 1/1999 |
| WO | 02079113 | A1 | 10/2002 |

OTHER PUBLICATIONS

Notice of the Second Office Action, and translation thereof, from Counterpart Chinese Patent Application No. 201180058454.9, dated Jan. 16, 2015, 8 pp.

Response to Examiner's Report dated Nov. 22, 2014, from Counterpart Australian Patent Application No. 2011311838, dated Feb. 22, 2015, 17 pp.

Patent Examination Report No. 2, from Counterpart Australian Patent Application No. 2011311838, dated Mar. 24, 2015, 3 pp.

Canadian Office Action from Canadian counterpart application No. 2,814,008, dated Feb. 26, 2014, 2 pp.

Chinese Office Action from Chinese counterpart application No. 20118005845.9, dated Aug. 5, 2014, 13 pp.

Australian Office Action from Australian counterpart application No. 2011311838, dated Nov. 22, 2014, 2 pp.

Response to Chinese Office Action from corresponding Application Serial No. 20118005845.9 filed on Nov. 25, 2014 (9 pages).

International Preliminary Report on Patentability from corresponding PCT Application Serial No. PCT/US2011/055462, 7 pages, dated Apr. 18, 2013.

International Search Report from corresponding PCT Application Serial No. PCT/US2011/055462, 3 pages, dated Apr. 17, 2012.

Third Office Action, and translation thereof, from counterpart Chinese Patent Application No. 201180058454.9, dated Apr. 27, 2015, 12 pp.

Fifth Office Action, and translation thereof, from counterpart Chinese Patent Application No. 201180058454.9, dated Apr. 20, 2016, 21 pp.

Decision on Rejection and Translation from counterpart Chinese Application No. 201180058454.9, dated Dec. 21, 2016, 2014, 8 pp.

Response to Extended Search Report dated May 9, 2017, from counterpart European Application No. 11831718.9, filed Dec. 6, 2017, 7 pp.

Extended Search Report from European Application No. 11831718.9, dated May 9, 2017, 9 pp.

Response to Indian Office Action dated Sep. 5, 2018, from counterpart Indian application No. 865/MUMNP/2013, filed Sep. 24, 2018, 62 pp.

Examination Report from counterpart European Application No. 11831718.9, dated Oct. 4, 2018, 5 pp.

Response to Indian Office Action dated Sep. 5, 2018, from counterpart Canadian application No. 865/MUMNP/2013, filed Sep. 24, 2018, 62 pp.

Examination Report, and translation thereof, from counterpart Indian Application No. 865/MUMNP/2013, dated May 9, 2018, 7 pp.

Notice of the Fourth Office Action, and translation thereof, from counterpart Chinese Patent Application No. 201180058454.9, dated Sep. 2, 2015, 8 pp.

First Office Action, and translation thereof, from counterpart Chinese Patent Application No. 201810699018.3, dated Apr. 1, 2020, 18 pp.

Second Office Action, and translation there of, from counterpart Chinese Patent Application No. 201810699018.3, dated Sep. 23, 2020, 21 pp.

Response to Examination Report dated Oct. 4, 2018, from counterpart European Patent Application No. 11831718.9, filed Feb. 1, 2019, 11 pp.

Notice of Intent to Grant and Text Intended to Grant from counterpart European Patent Application No. 11831718.9, dated Apr. 23, 2020, 32 pp.

Hearing Response, a communication issued by the Indian Patent Office, from counterpart Indian Application No. 865/MUMNP/2013, dated Nov. 20, 2020,12 pp.

Refusal Order, a communication issued by the Indian Patent Office, from counterpart Indian Application No. 865/MUMNP/2013, dated Nov. 20, 2020, 12 pp.

Third Office Action, and translation thereof, from counterpart Chinese Application No. 201810699018.3, dated May 10, 2021, 10 pp.

* cited by examiner

MICROWAVE ROTARY KILN

SUMMARY

In one embodiment, the disclosure is directed to an apparatus including a microwave source that emits microwave energy in a frequency range of about 300 Mhz to about 300 Ghz. A microwave cavity in the apparatus includes a stationary input section, a stationary output section, and a rotating processing section between the input section and the output section. A waveguide receives microwave energy from the microwave source and transmits the microwave energy into at least one of the input section and the output section.

In another embodiment, the disclosure is directed to a method including continuously introducing a sample material into a processing section of a microwave cavity; wherein the processing section includes a secondary coupler; introducing microwave energy into the cavity, wherein the secondary coupler absorbs the microwave energy and heats the sample material to a target temperature; rotating the processing section; and continuously removing the processed sample material from the processing section.

In yet another embodiment, an apparatus includes a microwave source, wherein the source emits microwave energy in a frequency range of about 300 Mhz to about 300 Ghz; a microwave cavity including a stationary input section, a stationary output section, and a rotating processing section between the input section and the output section; a waveguide to transmit the microwave energy from the source and introduce the microwave energy into at least one of the input section and the output section, wherein the stationary input section, the stationary output section and the rotating process section include a mating flange assembly, wherein the mating flange assembly includes at least one of an electrically conductive layer and an microwave absorbing layer.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference numerals in the figures designate like elements.

DETAILED DESCRIPTION

In one embodiment, the present disclosure is directed to a microwave (MW) rotary kiln apparatus with a microwave cavity including a stationary input section, a stationary output section, and a rotating processing section between the input and the output section. After a sample is introduced into the sample input section, microwave energy is introduced into at least one of the stationary input section and the stationary output section to process a sample in the rotating processing section. In one embodiment, the rotating processing section includes a secondary coupling source, and this "hybrid" system can make possible continuous processing of a sample of a non-microwave absorbing or slightly-microwave absorbing material. The apparatus may include a single rotating processing section or multiple rotating processing sections in series with one another.

Figure 1:
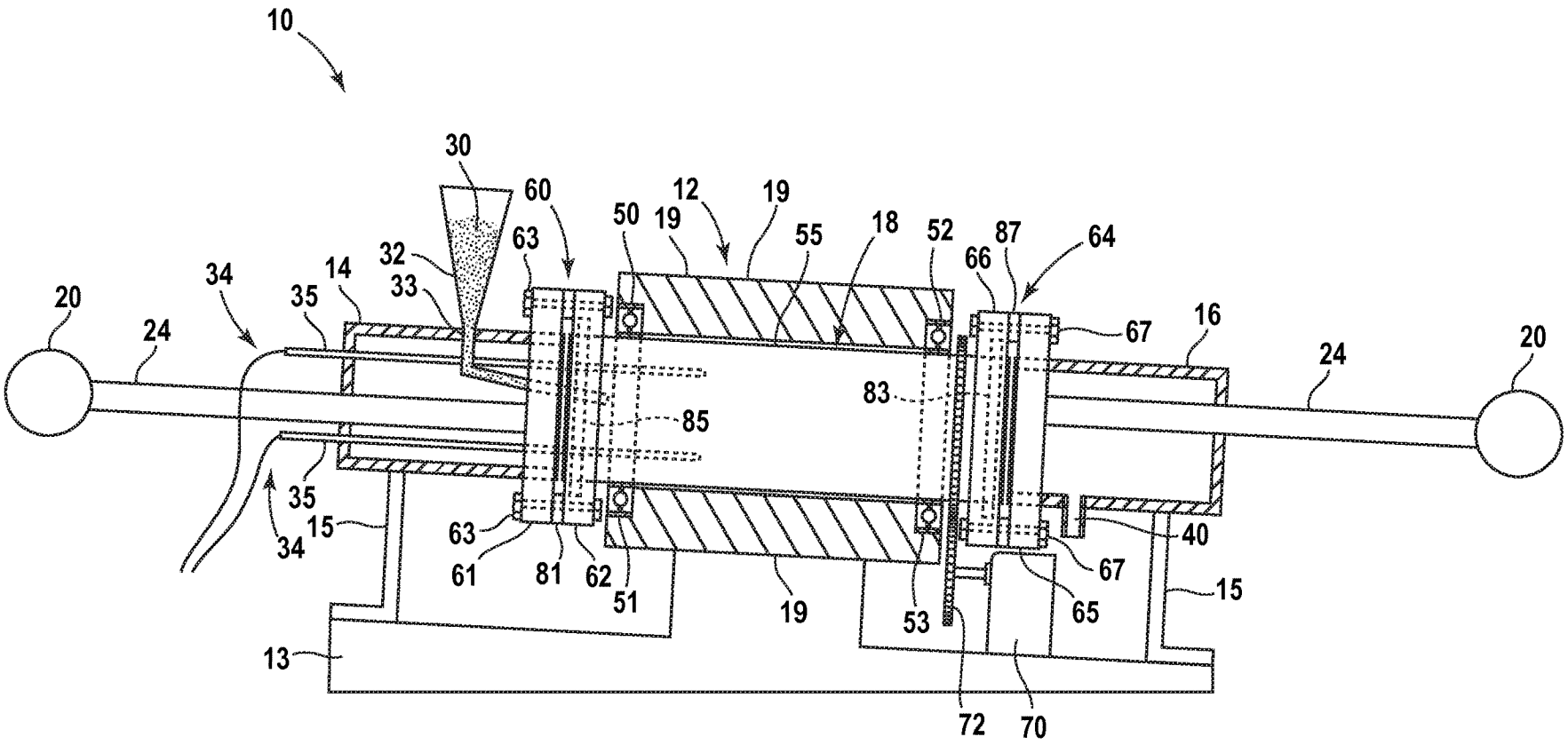
FIG. 1 is a cross-sectional view of an embodiment of a rotary microwave kiln apparatus.

Referring to FIG. 1, an apparatus 10 includes a microwave cavity 12 with a stationary (non-rotating) input section 14, a stationary (non-rotating) output section 16, and a rotating processing section 18. The longitudinal axis of the microwave cavity 12 may be parallel to a support 13, or may optionally be angled by appropriate support members 15 to facilitate movement of a sample through the cavity 12. The rotating processing section 18 may be any desired shape to process a selected sample, but is typically substantially cylindrical and has a substantially circular cross-sectional shape.

The rotating processing section 18 may be rotated by any suitable means, which may include a power source 70 such as electric motor or an internal combustion engine, and a drive system 72 to connect the power source 70 to the rotating processing section 18, which may include an arrangement of gears, sprockets, V-belts, chains or the like.

The stationary input section 14 and the stationary output section 16 are attached to the rotating processing section 18 by a pair of supports 60, 64. The support 60 includes a first support member 61 attached to the stationary input section 14. The first support member 61 is attached to a second support member 62 by an appropriate fastener, in this embodiment an arrangement of bolts 63. The second support member 62 includes a bearing 81, which may be, for example, a ball-bearing ring, which accepts an appropriately sized groove or track in a first end of the rotating processing section 18 to allow free rotation of the rotating processing section 18. The first support member 61 may optionally include a bearing if desired (not shown in FIG. 1).

The distance between the first and the second support members 61, 62 is optionally selected to prevent leakage of microwave energy from the space 85 between the first and the second support members 61, 62. However space 85, which is the distance between stationary input section 14 and rotating cavity 18, should be less than one quarter of the wavelength of the energy emitted by the microwave source 20. Optionally, the distance between the support members 61, 62 may be less than one quarter of the wavelength of the energy emitted by the microwave source 20.

Similarly, the support 64 includes a third support member 65 attached to the stationary output section 16, and a fourth support member 66 attached to the third support member 65 by an appropriate fastener, in this embodiment an arrangement of bolts 67. The fourth support member 66 includes a bearing 83, which may be, for example, a ball-bearing ring, which accepts an appropriately sized groove or track in a second end of the rotating processing section 18 to allow free rotation of the rotating processing section 18. The third support member 65 may optionally include a bearing if desired (not shown in FIG. 1). The distance between the support members 65, 66 can be optionally controlled to prevent leakage of microwave energy from the space 87. However space 87, which is the distance between stationary output section 16 and rotating cavity 18, should be less than one quarter of the wavelength of the energy emitted by the microwave source 20. Optionally, the distance between the support members 65, 66 may be less than one quarter of the wavelength of the energy emitted by the microwave source 20.

In the embodiment shown in FIG. 1, the rotating processing section 18 rotates within a pair of bearing rings 50, 52, which extend around the circumference of the outer body 55 of the rotating processing section 18. The bearing rings 50, 52 reside in grooves or troughs 51, 53 fashioned into a central support member 19. The bearing rings 50 and 52 support the weight of the rotating processing section 18, whereas stationary input section 14 and stationary output section 16 are supported by support members 15.

Either or both of the supports 60, 64 may optionally be at least partially encircled by a metallic screen (not shown in FIG. 1), which is also attached (electrically grounded) to the supports 60, 64. If used, the screen should have an appropriately sized mesh to prevent escape of microwave energy from the microwave cavity 12. If used, the screens are positioned around the circumference of the supports 60, 64 to protect the respective spaces 85, 87 from leaking microwave energy, as these spaces separate input/output cavities 14, 16 from the rotating cavity 18.

For example, the metallic screen should have apertures similar to the screen on the face of a kitchen microwave unit, which is designed to prevent microwave energy with a frequency of 2.45 Ghz from escaping from the unit. For microwave energy launched within the cavity 12 of frequencies other than 2.45 Ghz, a corresponding screen with openings of less than one quarter of the wavelength of the launched frequency must be used.

For additional microwave leakage protection, a water jacket made of a microwave transparent material (such as Teflon) (not shown in FIG. 1) can be wrapped around the circumference of the supports 60, 64, to aid in preventing escape of microwave energy from the spaces 85, 87.

At least one of the stationary input section 14 and the stationary output section 16 include a source of microwave energy 20, which can emit energy in a desired range for processing a selected sample material. The microwave source 20 emits microwave energy in a range from about 300 MHz to about 300 GHz, and some suitable frequencies for processing materials include, but are not limited to, 2.45 Ghz or 915 Mhz. Other frequencies can be used as well, but the larger the wavelength (or as frequency decreases) emitted by the source 20, the minimum size of the rotating processing section 18 must be increased to allow the selected frequency to propagate through the cavity 12.

In some embodiments, the microwave energy is introduced into the microwave cavity 12 by a suitable waveguide 24. Waveguide 24 may extend some distance into the stationary input section 14 and/or stationary output section 16 (as shown in FIG. 1). In some embodiments the waveguide 24 may only be attached to the surface of stationary input section 14 and/or stationary output section 16 such that the waveguide output opening is flush with the inner surface of the stationary input section 14 and/or stationary output section 16. A microwave transparent covering, such as a ceramic plate or panel, may optionally be placed over the opening of waveguide 24 to protect the microwave source 20 from dust and particulates that may be present within stationary input section 14 and/or stationary output section 16, but since it is microwave transparent it allows microwave energy from microwave source 20 to propagate into the system.

A sample 30 is introduced into the stationary input section 14 via a sample port or hopper 32, which is welded or affixed to the stationary input section 14. The sample port 32 can optionally be equipped with a vibratory feeder or other device to promote sample materials to flow into the rotating processing section 18. The stationary input section 14 may also optionally be lined with insulation to protect the input section 14 and waveguide 24 from heat generated within the microwave cavity 12. The dimensions of the sample port 32 are selected to be sufficiently large to allow smooth flow of the sample 30, but should be sufficiently small to prevent leakage of microwave energy from the sample input section 14. Typically, the sample port 32 is affixed to an opening in the stationary input section 14 that has a diameter less than about one quarter of the wavelength of the energy emitted by the microwave source 20. For example, a the sample port 32 may be made of a cylinder 33 affixed to an opening in the stationary input section 14 that is 1 inch in diameter and 5 inches in length for energy at 2.45 GHz frequency. A larger diameter opening would require the cylinder 33 to be longer.

The sample port 32 allows the sample 30 to smoothly flow into the rotating processing section 18, where the sample 30 is tumbled and continuously exposed to microwave energy from the microwave source 20. Exposure to the microwave energy heats the sample to a selected target temperature, and after the sample reaches the target temperature the sample flows out of the rotating processing section 18 and enters the stationary output section 16. The temperature of the sample 30 may optionally be monitored by at least one temperature measurement device such as, for example, a thermocouple or pyrometer 34. The thermocouple is protected from microwave energy by a conductive metal coating or sheath 35, which is electrically grounded to the microwave cavity 12. The thermocouple 34 may be used for monitoring temperatures within the system, and may also be used as a control feedback to the microwave source 20 to control power input to maintain temperatures within the rotating processing section 18. The thermocouple can merely extend perpendicularly into the body of the stationary input section 14 (FIG. 1) or it can be bent at an angle to allow it to extend parallel along the axis of the stationary input section 14 and extend beyond the physical space of the input section 14, or it can be added from a flat wall of the stationary input section 14 and run parallel to a longitudinal axis of the input section 14. Additionally, the stationary input section 14 can have ports drilled for introduction of a sample for processing or sight ports for viewing or addition of an optical or IR pyrometer (not shown in FIG. 1). Stationary output section 16 may include temperature monitoring and ports in a manner similar to those described for the stationary input section 14.

The sample may be removed from the apparatus 10 through an output port 40, or may optionally be introduced into another downstream processing section (not shown in FIG. 1) for further processing using microwave energy, thermal energy or any other processing technique. The exit port 40 maybe made large enough to allow processed sample material to exit, but also must be made in a manner that does not allow microwave energy to escape. The exit port 40 may optionally be lined with thermal insulation.

Figure 5:
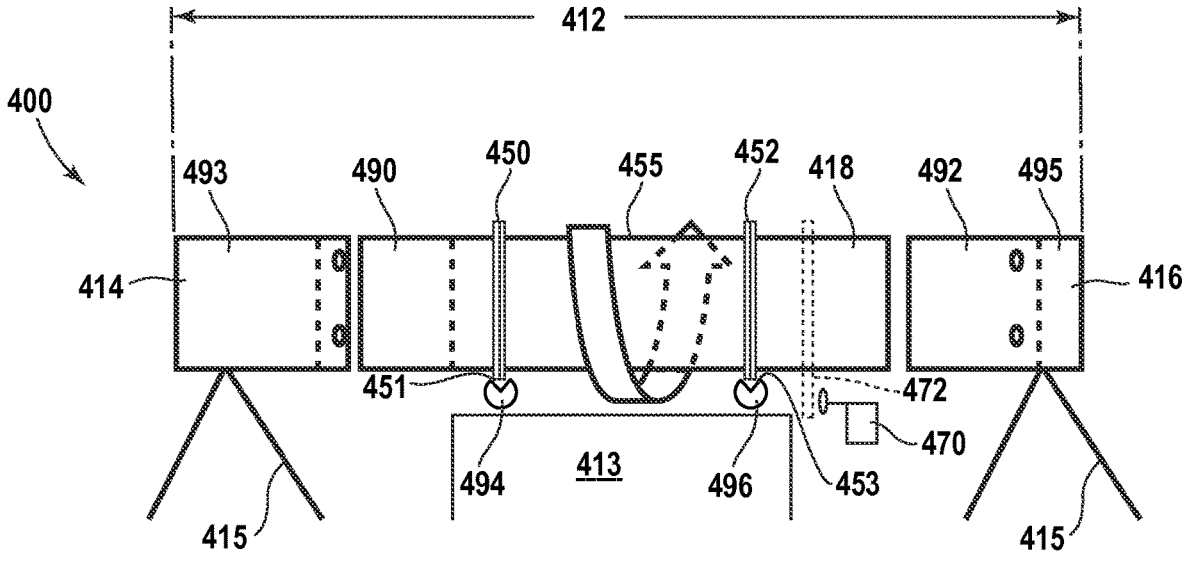
FIG. 5 is a schematic plan view of an alternative embodiment of a rotary microwave kiln apparatus including sliding choke cylinders.

In an alternative embodiment shown in FIG. 5, an apparatus 400 includes cylindrical members 490, 492 attached to a stationary input section 414 and a stationary output section 416, respectively. The stationary input section 414 and the stationary output section 416 are supported by support members 415. A rotating processing section 418 is supported within a pair of bearing rings 450, 452 (similar to the bearing rings 50, 52 shown in FIG. 1), which extend around the circumference of an outer body 455 of the rotating processing section 418. The rotating processing section 18 rotates within the cylindrical members 490, 492.

The bearing rings 450, 452 can reside in grooves or troughs fashioned into a central support member like member 19 in FIG. 1. In the embodiment of FIG. 5, the rings 450, 452 are supported in grooves 451, 453 in wheeled assemblies 494, 496, which allow the rings 450, 452 to roll without restriction. The wheeled assemblies 494, 496 are supported on a chassis or frame 413.

The rotating processing section 418 may be rotated by any suitable means, which may include a power source 470 such as an electric motor or an internal combustion engine, and a drive system 472 to connect the power source 470 to the rotating processing section 418, which may include an arrangement of gears, V-belts or the like.

The cylindrical members 490, 492 may optionally slide and advance/retract along the outer surfaces 493, 495 of the input sections 414, 416 to allow removal of the rotating processing section 418 and provide an adjustable choke to prevent leakage of microwave energy from the microwave cavity 412 (the cylindrical member 492 is shown in a retracted position in FIG. 5).

The cylindrical members 490, 492 are made of a conductive material such as a metal and may slide over the rotating processing section 418 to prevent leakage of microwave energy from the microwave cavity 412. The cylinders 490, 492 could be optionally be electrically connected to the rotating processing section 418. An interior surface of the cylindrical members 490, 492 may optionally include at least one of metal brushes, metal pins, metal dimples and the like (not shown in FIG. 5) to aid in preventing the escape of electrical energy from the microwave field, while still allowing the section 418 to freely rotate.

Figure 2:
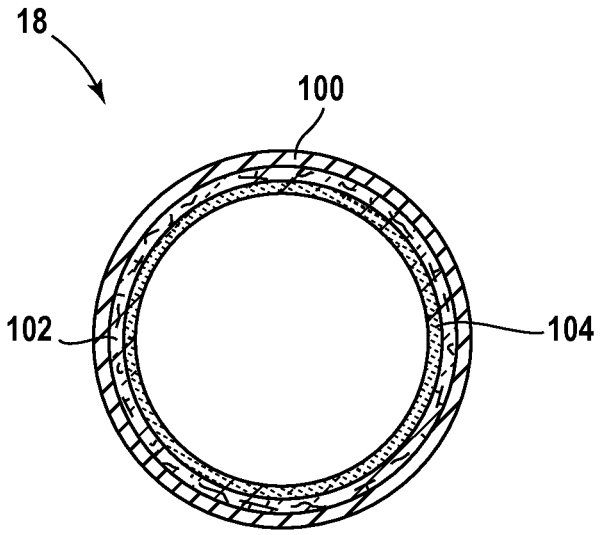
FIG. 2 is a cross-sectional view of an embodiment of a rotary processing section in the rotary microwave kiln of FIG. 1.

Referring to FIG. 2, a cross-section of the rotating processing section 18 includes an outer surface 100 and an insulating layer 102. The insulating layer 102 is optionally in direct contact with the outer surface 100 and may be made from any material that is not absorptive or weakly absorptive to microwave energy. Suitable materials for the layer 102 include, but are not limited to, $Al_2O_3$, $SiO_2$, mullite, and cordierite or composites of similar materials.

The rotating processing section 18 further includes a secondary coupling layer 104 which is typically located within the insulating layer 102. The secondary coupling layer 104 is very microwave absorptive and may be a pure single-phase absorbing material, or a composite material made of several different materials that are microwave absorbing and non-microwave absorbing. Suitable microwave absorbing materials include, but are not limited to, electrically semiconducting materials (n-type or p-type semiconductors), ionically conducting materials (ion conductors), dipolar materials, magnetically permeable materials, or a material that changes phases or undergoes a reaction to alter its microwave absorptive properties. Suitable materials for the secondary coupling layer 104 include, but are not limited to, SiC, partially stabilized zirconia, magnetite, zeolites, and β-alumina.

The material in the secondary coupling layer 104 should be selected to facilitate heating a sample that is non-microwave absorbing or weakly microwave absorbing at ambient temperature, up to a temperature at which the sample becomes microwave absorbing or dielectrically lossy. This change in the microwave absorbing properties of the sample, as a function of increasing temperature provided by the secondary coupling layer 104, can make possible continuous microwave-assisted processing of a non-microwave absorbing sample within the rotating processing section 18.

In some embodiments, the secondary coupling layer 104 is attached to the insulating layer 102 by a high-temperature ceramic cement. The secondary coupling layer 104 can also be attached to the insulating layer 102 by forming the body 100 with periodic "teeth" or gears around the circumference of the end of the rotating processing section 18 that could be fit into mating ceramic gear set that is attached to the outer insulation via cementing or as a gear assembly mating with the outer insulation.

Additionally, a non-microwave thermal energy source can be used to supply additional heat within the rotating processing section 18 to create a "hybrid" system. This thermal source can be in the form of electrical resistance heating, gas-burner heating as well as other electromagnetic sources, such as infrared or IR heating. Using a non-microwave energy source can aid the secondary coupling layer 104 in heating the sample or even remove the need for the layer 104 altogether.

In some embodiments the secondary coupling layer 104 may be a substantially continuous tube-like or cylinder-like layer, while in other embodiments the layer 104 may be made of bricks, squares, plates, rods, discs or any other geometric shape affixed around the inner surface of the insulating layer 102 or imbedded within the insulating layer 102 in some manner. These bricks, squares, rods or any other geometric shape material are microwave absorbing materials maybe applied to the insulating layer 102 by, for example, tape casting, slip casting, sol-gel techniques, CVD, PVD, electrostatic coating, drop coating, brush coating, spray coating. In other embodiments, alternative application techniques may be used to attach the bricks, rods, and the like to the insulating layer 102, including, but not limited to, gluing or cementing individual articles or pieces as well as groups of articles or pieces of the microwave absorbing materials to the insulating layer 102. In other embodiments layer 104 can actually be applied to layer 102 as a coating or a paste of materials that are microwave absorbing.

In other embodiments, a protective layer of, for example, a ceramic material, may be applied to the secondary absorbing layer 104 to prevent direct contact with the sample being processed or to prevent potential reaction of the materials in the absorbing layer 104 with atmosphere within the rotating processing section 18 or within the entire apparatus 10 at elevated temperatures. This protective layer or coating may be applied at any thickness deemed appropriate to curtail or prevent any reactions caused by contact with the sample being processed or the gases from the atmosphere within the entire apparatus. This coating maybe oxide-based, non-oxide based or mixtures of oxides and non-oxide materials.

Figure 3:
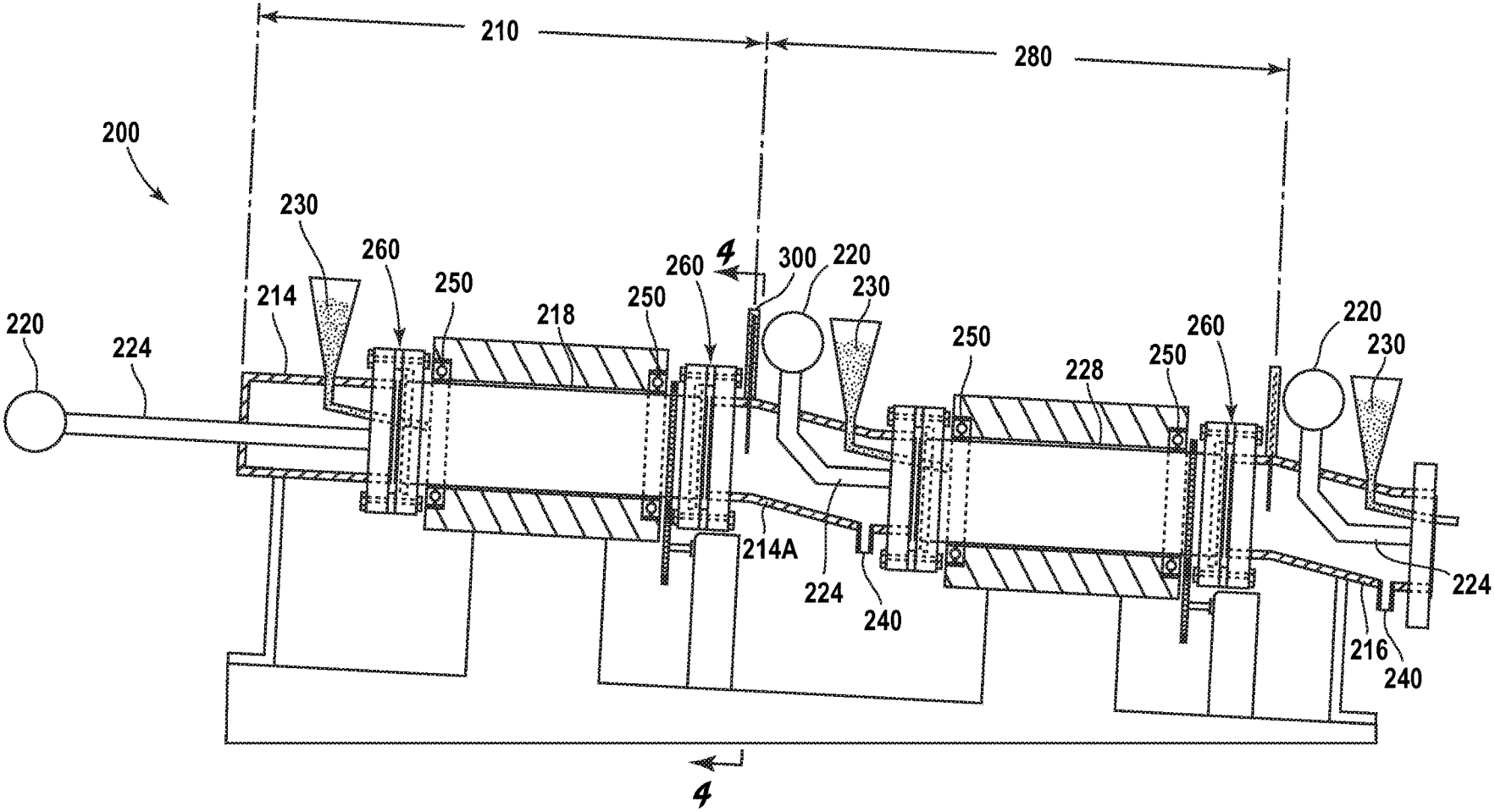
FIG. 3 is a cross-sectional view of an embodiment of a multi-zone rotary microwave kiln apparatus.

Referring to FIG. 3, a multi-zone apparatus 200 may include a series of microwave cavities 210, 280 to further process a sample material. Each microwave cavity may optionally include a microwave source 220 and a waveguide 224, which may or may not utilize the same output frequency. Waveguide 224 may extend some distance into the stationary input section 214, 214A and/or stationary output section 216 (as shown in FIG. 3). In some embodiments waveguide 224 may only be attached to the surface of stationary input section 214, 214A and/or stationary output section 216 such that the waveguide output opening is flush with the inner surface of the stationary input section 214, 214A and/or stationary output section 216. A microwave transparent covering, such as a ceramic plate or panel, may optionally be placed over the opening of waveguide 224 to protect the microwave source 220 from dust and particulates that may be present within stationary input section 214, 214A and/or stationary output section 216, but since it is microwave transparent it allows microwave energy from microwave source 220 to propagate into the system. Each of the microwave cavities may optionally include a rotating processing section 218, 228, as described above with reference to FIG. 1, which is attached to a stationary input section 214, 214A and/or a stationary output section 216. Sample materials may be introduced into and/or removed from any cavity within the apparatus 200 via sample ports 230 or exit ports 240, and the input/output sections 214, 214A and 216 may be attached to one another using ball-bearing assemblies 250 and supporting bearing members 260 as described with reference to FIG. 1 above. The rotating processing sections 218, 228 may optionally include a secondary absorbing material to further process the sample.

The stationary input section 214A is a stationary portion of the apparatus 200 that separates the first rotating processing section 218 and the second rotating processing section 228, and is essentially a transition zone that can be used to for adding more temperature probes, an additional sample feeder, an additional microwave source, or to choke microwave energy from entering the cavities rotating processing sections 218 and/or 228. Additionally, the section 214A can contain ports for use of pyrometer or for the addition of another sample feeder or to add a process cover gas.

Figure 4:
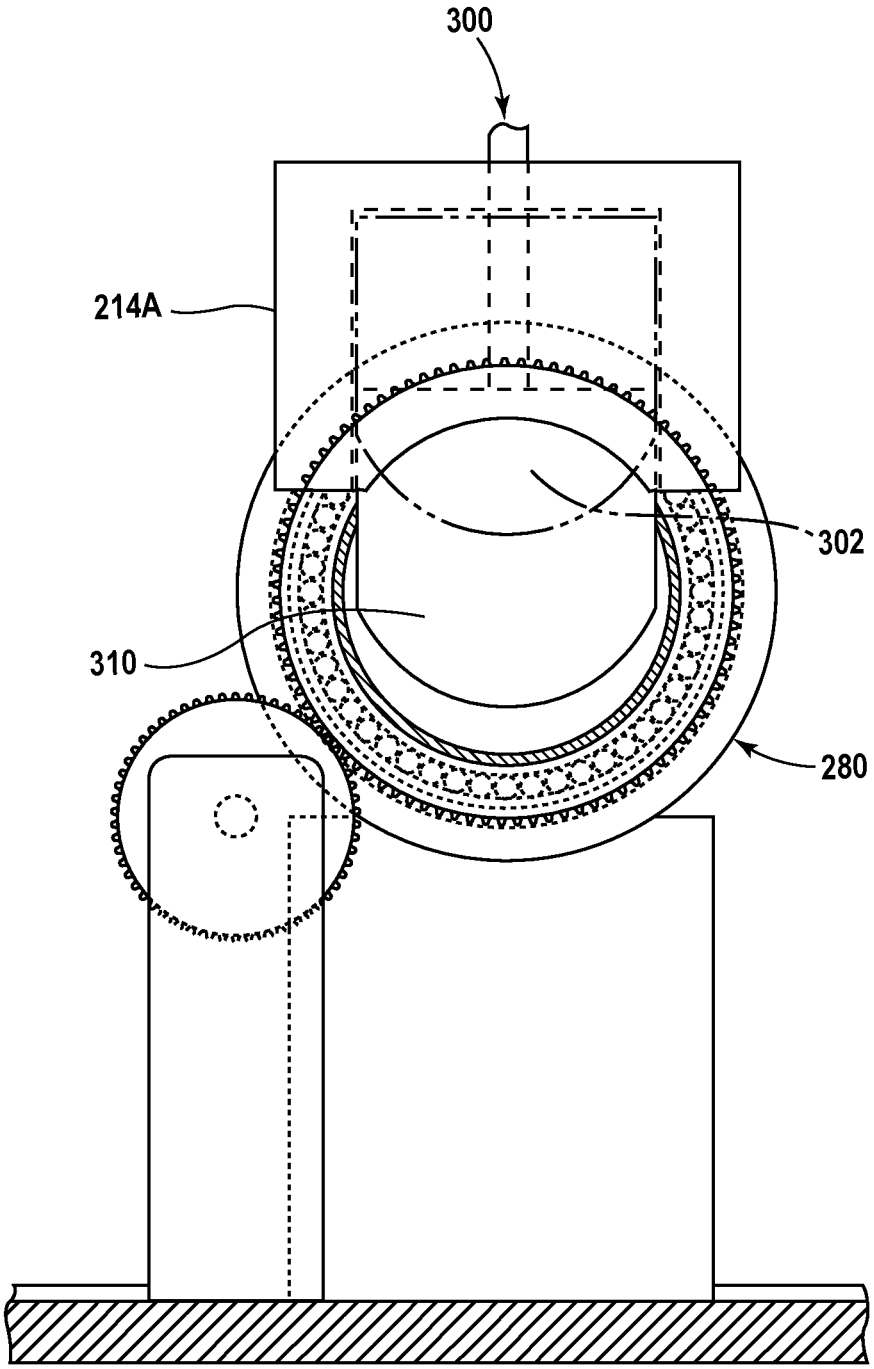
FIG. 4 is a cross-sectional view of an embodiment of a slideable choke in a portion of the multi-zone microwave kiln of FIG. 3.

In the example shown in FIG. 3, the stationary input section 214A includes an adjustable, slidable choke 300, which is also shown in FIG. 4. The choke 300 includes a moveable choking member 302 that prevents to a large degree or totally (depending upon the size of the choke opening 310), microwave energy from escaping into the second microwave cavity 280 from the first microwave cavity 210. The choking member 302 is a metallic plate that would allow sample to flow through from the first microwave cavity 210 to the second microwave cavity 280, but not microwave energy. This choking member 302 may optionally be covered in ceramic insulation to protect it from the hot sample and the hot microwave cavities 210, 280.

In addition to, or in the absence of, choking member 302, a screen or an arrangement of bars (not shown in FIG. 4) may be placed in the choke opening 310. The screen should be small enough to prevent microwave from escaping, and large enough to allow sample to flow through the stationary input section 214A and into the rotating processing section 228.

The screen may optionally be insulated from the hot sample and any secondary couplers in the rotating processing sections 218, 228. In another embodiment, the screen (or the choking member 302) can be attached to the rotating processing sections (permanently affixed or locked/screwed into the rotating cavity to allow removal for maintenance) such that the choke system can be a part of the rotating cavity.

Additionally the screen can serve as a support to keep insulation layer 102 and layer 104 (FIG. 2) inside the rotating processing sections 218, 228.

In another aspect, the present disclosure is directed to a method for processing a sample. Referring again to FIG. 1, a sample material 30, which may be non-microwave absorbing or microwave absorbing at the frequency emitted by the microwave source 20, is introduced via a sample port 32 into a microwave cavity 12 including a stationary sample input section 14. The sample material then enters a rotating processing section 18 downstream of the sample input section 14. The rotating processing section 18 optionally includes a secondary coupler layer 104 made of a microwave absorbing material, which heats the sample to an elevated temperature due to its dissipation of absorbed microwave energy as heat. At the target temperature, the secondary coupler layer 104 can still be employed to heat the sample material to temperatures above the target temperature if such heating is beneficial in increasing process efficiency and/or throughput.

The sample is then removed from an output port 40 in a stationary output section 16 of the microwave cavity downstream of the rotating processing section 18.

In the presently described method, the speed of throughput is determined by the set angle of the apparatus and the speed of the rotating cavity, as typical in a conventional rotating kiln. Any or all of the apparatus set angle, the rotating speed of the rotating processing section 18, and the optional secondary coupler material in the rotating processing section 18 can be selected to provide continuous flow or substantially continuous processing of the sample. In this application the term continuous refers to a process in which the sample is supplied continuously (in an uninterrupted flow) to the sample port 30, and then continuously withdrawn from the output port 40.

Embodiments will now be described in the following non-limiting examples.

EXAMPLES

Example 1

Figure 7:
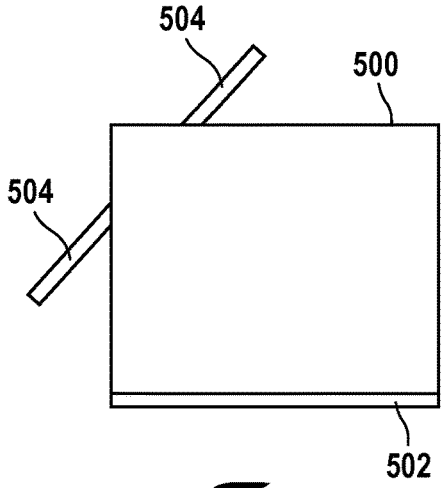
FIG. 7 is a top view of a microwave unit including a microwave choke, as described in Example 1.
Figure 8:
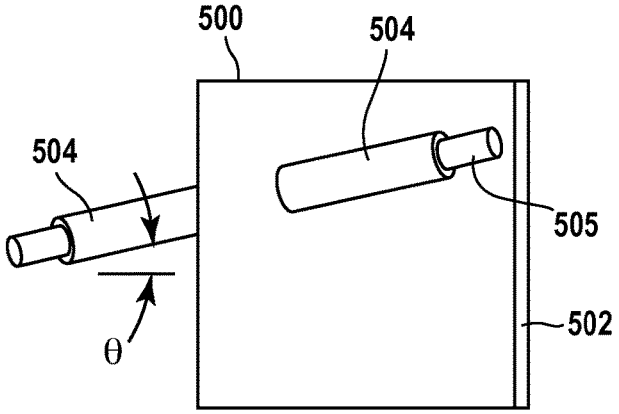
FIG. 8 is a side view of the microwave unit of FIG. 7, including an alumina tube in the choke.

Referring to FIGS. 7-8, two stainless steel chokes 504 were bolted on a stainless-steel commercial microwave unit 500 with a door 502. The chokes were bolted on the microwave unit 500 diagonally (having a tilt angle θ of about 4°) such that there was a clear line of view through the open chokes. The chokes 504 were open cylindrical tubes having an inner diameter of about 1.24 inches (about 3 cm) and a length of about 5 inches (about 13 cm). When the microwave unit 500 was turned on, the open ends of the chokes 504 were measured for microwave leakage, and the levels measured were well below accepted standards for leakage.

Referring to FIG. 8, a spatula was used to place a thick paste of mixed SiC powder and $\alpha$-$Al_2O_3$ powder within a 1-inch (2.5 cm) outer diameter, 0.7 inch (1.8 cm) inner diameter $\alpha$-$Al_2O_3$ or $\alpha$-alumina tube 506 having an overall length of 18 inches (46 cm). The paste was dried with a heat gun to form a coating layer of the dried paste, which had a length of about 2 inches (5 cm). The coating layer was placed near the center of the alumina tube 506 and within the enclosure of the microwave unit 500 in such a manner that any heating could be observed within the microwave unit 500 through the door 502. Surrounding the exposed portion of the alumina tube 506 a clamshell (not shown in FIG. 8) made of alumina fiberboard with a circular opening in the front for viewing was placed around the alumina tube 506 to aid in maintaining heat.

Example (1)A

After the coated paste along the alumina tube 506 and within the microwave unit 500 was allowed to dry, the microwave unit 500 (1.2 kW total power) was set on "high," which allowed the total output power to be applied, for a period of 9 minutes before a glowing was observed within the coated alumina tube 506. The unit 500 was shut down, the door was opened, and a thermocouple was placed through the circular opening of the alumina fiberboard in contact with the alumina tube 506, and a temperature of 746° C. was recorded.

Example (1)B

An uncoated alumina tube with the same dimensions as the previously coated alumina tube in Example (1)A above was inserted through the chokes 504 as shown in FIG. 8, and the procedure of Example (1)A was repeated. The recorded temperature after 9 minutes from a cold start was 178° C., showing the effect of the secondary coupling coating used in Example (1)A.

Example (1)C

Using the same setup as described in FIG. 8, an alumina tube 506 coated with a paste of 3% yttria stabilized $ZrO_2$ powders was placed within the chokes 504 in a similar manner as set forth above in Examples (1) and (1)A. The microwave unit 500 was set on "high", allowing for the total output power to be applied, for a period of 15 minutes before a glowing was observed within the alumina tube 506. According to the procedure in Example (1)A above, a temperature of 826° C. was recorded.

Example (1)D

Using the same setup described in FIG. 8, an alumina tube 506 coated with a paste of 10% yttria stabilized $ZrO_2$ powders in a similar manner as described in Example (1)A above was placed within the chokes 504. The unit 500 was set on "high," allowing for the total output power to be applied, for a period of 12 minutes before a glowing was observed within the alumina tube 506. According to the procedure in Example (1)A above, a temperature of 898° C. was recorded.

Example (1)E

Using the same setup described in FIG. 8, pieces of crushed β-alumina were placed within the alumina tube 506, and the tube 506 was placed within the chokes. The unit 500 was set on "high," allowing for the total output power to be applied, for a period of 8 minutes before a glowing was observed within the alumina tube 506. According to the procedure in Example (1)A above, a temperature of 925° C. was recorded.

Example 2

Figure 6:
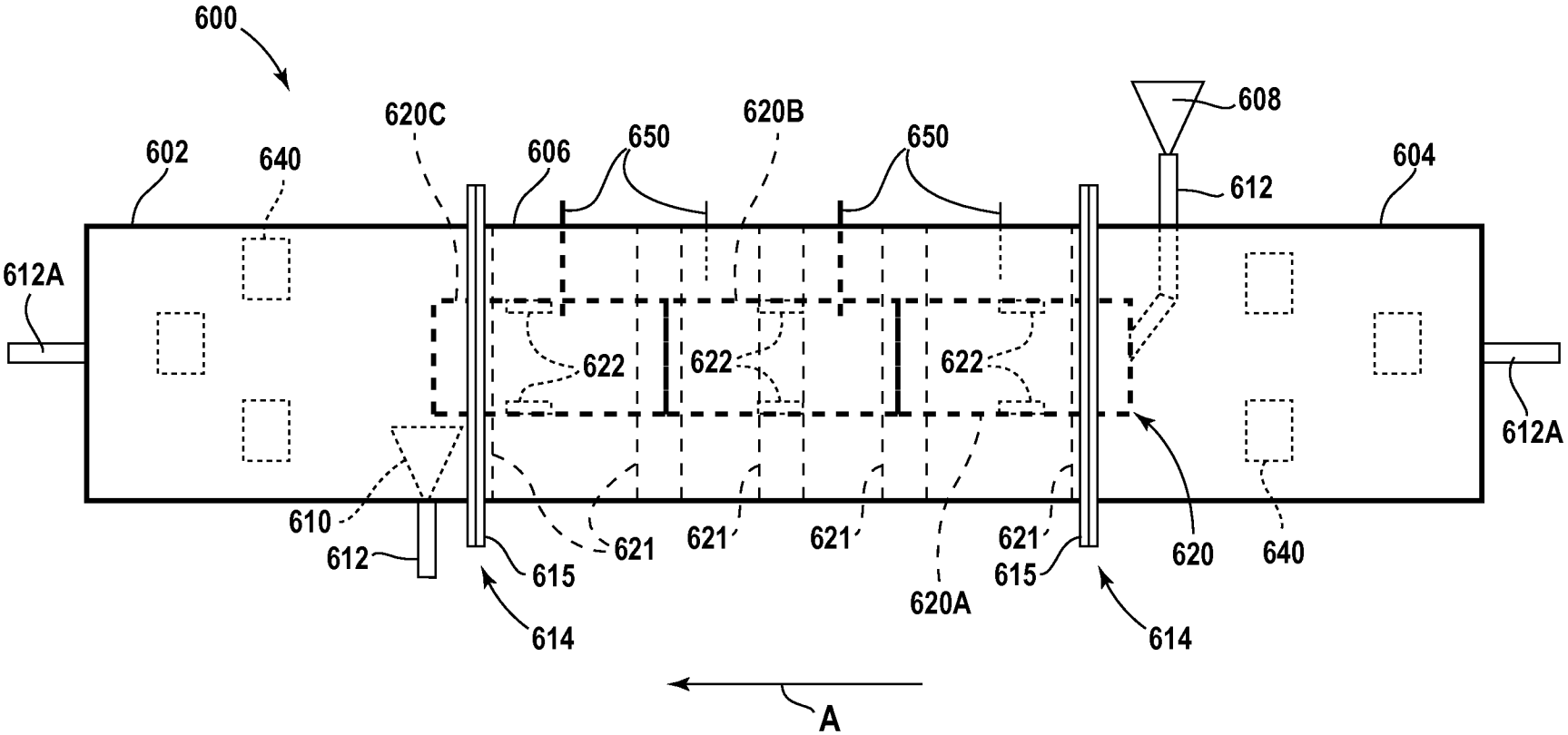
FIG. 6 is a schematic cross-sectional view of the rotary microwave kiln apparatus utilized in Example 2.

Referring to the schematic in FIG. 6, a rotary microwave kiln 600 was constructed with 3 individual steel sections 602, 604, 606. All 3 sections 602-606 were supported on a large frame (not shown in FIG. 6, see example in FIG. 1) such that the center section 606 was supported on rollers (not shown in FIG. 6, see example in FIG. 1) that allowed for free rotation. The center section 606 was driven by a gear motor via a chain engaging a sprocket around its circumference (not shown in FIG. 6).

The two end sections 602, 604 were stationary and did not rotate in this example, and both serve as inlets for microwave power (or alternatively one section may input energy and the other may not). In FIG. 6, the end section 604 included an inlet funnel 608 to allow introduction of the sample to be processed, and the end section 602 included an outlet funnel 610 for sample that has been processed.

An arrangement of cylindrical "chokes" 612 having a 1.5 inch (3.8 cm) inner diameter and 5 inches (13 cm) in length were welded to the end sections 602, 604 for sample output/input, but were appropriately sized to prevent leakage of energy in the frequency range of 2.45 GHz. End chokes 612A were included to allow viewing of the operation of the unit 600.

Figure 9:
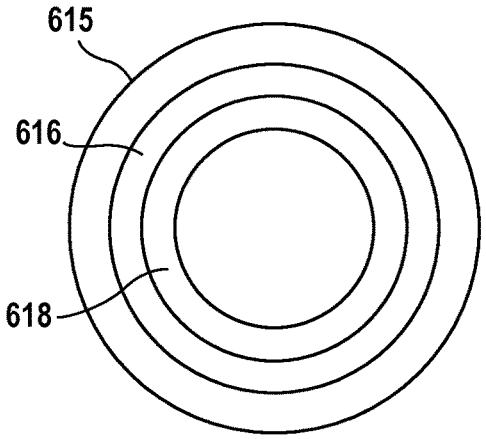
FIG. 9 is an end view of a section of the rotary microwave kiln apparatus of FIG. 6.

In the area between each section 602, 604 and the center section 606 are mating flanges or collars 615 that form rotary choke assemblies 614. When the device 600 is in operating position the flanges 615 in the rotary choke assemblies 614 are nearly in contact. At the interface between mating sections 602, 604, 606, layers of electrically conductive and/or microwave absorptive materials were arranged from the inner diameter of the flanges 615 to the outer diameter thereof (see end view of a section 602, 604 or 606 in FIG. 9). In this example, each of the sections 602-606 included an electrically conductive layer 618 and a microwave absorptive layer 616. When the device 600 is in operating position, the flanges 615 on the sections 602 and 606 abut one another, and the flanges 615 on the sections 606 and 604 abut one another. The layers 616, 618 on each section contact an opposed mating flange to provide an electrical short that prevents leakage of microwave energy.

In this example, the electrically conductive layer 616 was a beryllium copper foil, and the microwave absorptive material 618 was a barium ferrite rope. These layers allowed the rotary choke assemblies 614 to act as microwave chokes.

The flanges 615 were brought into contact by sliding the stationary ends 602, 604 forward until the flanges 615 on each section abutted the flanges 615 on the rotatable center section 606.

To add stability within the rotary choke assemblies 614 and further reduce microwave leakage, bearing rings (not shown in FIG. 6, see example in FIG. 1) were used to clamp the flanges 615 in place. In another embodiment, clamps were also used with ball bearings to allow rotation of the center section 606 while maintaining the contact between adjacent flanges 615 in the rotary choke assemblies 614.

The sample inlet funnel 608 fed into a process tube 620, which was made of alumina and silica fiberboard. The process tube 620 included three sub-sections 620A, 620B, 620C, each supported by insulating rings 621. Affixed around the inner diameter of the process tube 620 were $SiC/Al_2O_3$ (containing 7% SiC by weight) composite bricks 622 fabricated by hot-pressing techniques. The bricks 622 measured 2 inches (5 cm) by 4 inches (10 cm) by 0.3 inches (0.8 cm). The process tube 620 included 3 rows of bricks 622 down the length thereof, and each row contained 3 bricks 622 mounted roughly 120 degrees apart around the inner circumference of the process tube 620. The bricks 622 were held in place with alumina ceramic cement.

The portion of the process tube 620 in the section 602 was arranged over a stainless steel or quartz outlet funnel 610 which allows the sample to exit through the choke 612.

In the embodiment shown in FIG. 6, the unit 600 is capable of emitting about 12 kW of microwave power by having twelve 1 kW magnetrons 640, with 6 magnetrons 640 affixed to each section 602, 604. Impedance matching was done with a standard network analyzer through each magnetron input area. In another embodiment the microwave generator output was about 30 kW for 2.45 Ghz systems, up to 100 kW for 915 Mhz systems. Microwave energy can be input through one of both of stationary sections 602, 604.

Temperature is measured by thermocouples 650 that extend into the processing tube 620 within the rotary section 606. Using a controller system, the feedback from the thermocouples 650 was used to control the internal temperature with the tube 620. In another embodiment, temperature can be monitored wirelessly by affixing a receiver to the stationary sections 602, 604. The receiver can receive signals from transmitters attached directly to the thermocouples 650.

Example (2)A 12 kW of microwave power was launched through the system by attachment of twelve 1 kW magnetrons 640 (6 affixed on each of the stationary sections 602, 604) and the temperature in the process chamber 620 was adjusted to about 1000° C. as measured by the thermocouples 650. The rotating chamber 606 was set for 8 rpm (revolutions per minute) and the system was adjusted such that the process chamber 620 had a downward angle of about 4° to allow sample flow along the direction of the arrow A of FIG. 6.

Kaolin powder was poured into the sample inlet pipe 608, and after about 20 minutes sample began to trickle out of the process chamber 620 in a steady stream and into the outlet port funnel 610. The temperature of the sample was measured as about 850-870° C., which was likely due to cooling as the samples exited the system.

Example (2)B

Under the same conditions as set forth in Example (2)A above, anatase powder ($TiO_2$) was loaded into and fed through the sample inlet funnel 608 and allowed to pass through the process tube 620 at 800° C., above the conversion temperature of anatase to rutile (about 570-610° C.). The resulting sample powder was collected in a stainless steel bin and characterized using x-ray diffraction to show the rutile phase of $TiO_2$.

Various embodiments of the invention have been described. These and other embodiments are within the scope of the following claims.

The invention claimed is:

1. An apparatus, comprising: a microwave source, wherein the source emits microwave energy in a frequency range of 300 Mhz to 300 Ghz;

at least one microwave cavity comprising a stationary input section, a stationary output section, and a rotating processing section rotating around a substantially horizontal axis between the input section and the output section, wherein the rotating processing section comprises:

a body;

an insulating layer on the body, wherein the insulating layer is chosen from $Al_2O_3$, $SiO_2$, mullite, cordierite, and composites thereof;

a coating of a secondary coupling layer on the insulating layer, wherein the secondary coupling layer is chosen from SiC, partially stabilized zirconia, magnetite, zeolite, beta alumina, and composites and combinations thereof; and a protective coating on the secondary coupling layer, wherein the protective coating comprises an oxide, a non-oxide, and mixtures thereof; and a waveguide to transmit the microwave energy from the source and introduce the microwave energy into at least one of the input section and the output section.

2. The apparatus of claim 1, wherein the input section and the output section comprise a sample port, and wherein the sample ports have a length equal to one quarter of the wavelength of the energy emitted from the microwave source.

3. The apparatus of claim 1, further comprising:

a first support member attached to the stationary input section, and a second support member attached to the first support member, wherein the second support member comprises a bearing to accept a first end of the rotating processing section, wherein a distance between the first and the second support members is sufficiently small to prevent leakage of microwave energy;

a third support member attached to the stationary output section, and a fourth support member attached to the third support member, wherein the fourth support member comprises a bearing to accept a second end of the rotating processing section, wherein a distance between the third and the fourth support members is sufficiently small to prevent leakage of microwave energy.

4. The apparatus of claim 3, further comprising a first bearing ring adjacent to the first end of the rotating processing section, and a second bearing ring adjacent to the second end of the rotating processing section, wherein the first and the second bearing rings are supported by a central support member, and wherein the bearing rings extend around a circumference of an outer body 55 of the rotating processing section.

5. The apparatus of claim 3, further comprising a screen mesh around the circumference of at least one of the first and the second support member, or the third and the fourth support member.

6. The apparatus of claim 1, further comprising a first cylindrical member connected to the stationary input cavity, and a second cylindrical member connected to the stationary output cavity, wherein the first cylindrical member extends over a first end of the rotating processing section, and the second cylindrical member extends over the second end of the rotating processing section, and wherein the cylindrical members are sized to prevent microwave leakage from the microwave cavity.

7. The apparatus of claim 6, wherein the first and the second cylindrical members slidably retract onto the stationary input/output sections.

8. The apparatus of claim 6, wherein the cylindrical members comprise an electrically conductive material.

9. The apparatus of claim 8, wherein the electrically conductive material is a metal selected from steel, aluminum, and copper.

10. The apparatus of claim 6, further comprising an electrical conductor between at least one of the first and the second cylindrical members and the rotating processing section.

11. The apparatus of claim 10, wherein the conductors comprise at least one of brushes, pins, and a dimpled surface on an inner surface of the cylindrical members.

12. The apparatus of claim 1, wherein the protective layer comprises a ceramic material.

13. The apparatus of claim 1, wherein the rotating cavity further comprises a temperature monitoring device.

14. The apparatus of claim 13, wherein the temperature monitoring device is a thermocouple.

15. The apparatus of claim 1, wherein at least one of the stationary input cavity and the stationary output cavity comprises a microwave choke.

16. The apparatus of claim 15, wherein the choke comprises a slidable plate that extends into the cavity, and wherein the plate extends into the cavity a distance such that the opening in the cavity is large enough to allow sample to flow through but small enough to prevent microwave leakage from the microwave cavity.

17. The apparatus of claim 15, wherein the choke comprises at least one of a screen or an arrangement of bars in the cavity, and wherein an opening in the screen or bars is large enough to allow sample to flow through but small enough to prevent microwave leakage from the microwave cavity.

18. The apparatus of claim 1, wherein the apparatus comprises more than one microwave cavity.

19. The apparatus of claim 1, wherein the stationary input section, the stationary output section and the rotating process section comprise a mating flange assembly, wherein the mating flange assembly comprises at least one of an electrically conductive layer and an microwave absorbing layer, and wherein the electrically conductive layer comprises a beryllium copper foil, and the microwave absorptive layer comprises barium ferrite.

20. A method, comprising:

continuously introducing a sample material into a processing section of a microwave cavity; wherein the processing section comprises:

a body;

an insulating layer on the body, wherein the insulating layer is chosen from $Al_2O_3$, $SiO_2$, mullite, cordierite, and composites thereof;

a coating of a secondary coupling layer on the insulating layer, wherein the secondary coupling layer is chosen from SiC, partially stabilized zirconia, magnetite, zeolite, beta alumina, and composites and combinations thereof; and a protective coating on the secondary coupling layer, wherein the protective coating comprises an oxide, a non-oxide, and mixtures thereof; and introducing microwave energy into the cavity at a stationary input section, wherein the secondary coupler absorbs the microwave energy and heats the sample material to a target temperature;

rotating the processing section rotating around a substantially horizontal axis between the input section and a stationary output section; and continuously removing the processed sample material from the processing section at the stationary output section.

21. The method of claim 20, wherein the sample material is non-microwave absorbing.

22. The method of claim 20, wherein the sample material is microwave absorbing.

23. The method of claim 20, wherein the microwave cavity further comprises a waveguide to introduce microwave energy into the processing section.

24. The method of claim 20, further comprising thermally heating the sample in the processing section.

* * * * *